US005322365A

United States Patent [19]

Teufel et al.

[11] Patent Number: 5,322,365

[45] Date of Patent: Jun. 21, 1994

[54] VERTICALLY ADJUSTABLE EXTENSION DRAWERS

[75] Inventors: Rainer B. Teufel; Timothy A. Friar, both of Columbus, Ohio

[73] Assignee: Artromick International, Inc., Columbus, Ohio

[21] Appl. No.: 63,259

[22] Filed: May 18, 1993

Related U.S. Application Data

[63] Continuation of Ser. No. 867,134, Apr. 10, 1992, Pat. No. 5,211,461.

[51] Int. Cl.[5] ..... B65D 43/12

[52] U.S. Cl. ..... 312/330.1; 70/63; 70/164; 70/170; 220/351; 312/249.11

[58] Field of Search ..... 312/249.11, 330.1, 334.13; 220/351; 292/304; 70/63, 85, 158, 163, 164, 166-169, 170-173, DIG. 34

[56] References Cited

U.S. PATENT DOCUMENTS

| | | | |
|---|---|---|---|
| 2,032,375 | 3/1936 | Moore | 292/304 |
| 2,220,319 | 11/1940 | Curtis | 292/304 |
| 2,994,447 | 8/1961 | Haynes | 70/63 X |
| 3,166,364 | 1/1965 | Shorin, Jr. | 70/85 |
| 3,204,436 | 9/1965 | Nemsky | 70/63 |
| 3,462,208 | 8/1969 | Black et al. | 312/330.1 X |
| 3,490,823 | 1/1970 | Neu et al. | 312/330.1 X |
| 3,834,778 | 9/1974 | Morrison et al. | 312/330.1 X |
| 4,159,780 | 7/1979 | Romaine | 215/296 X |
| 4,462,317 | 7/1984 | Franko et al. | 292/304 X |
| 4,917,254 | 4/1990 | Ciriacks | 220/351 X |

FOREIGN PATENT DOCUMENTS

| | | | |
|---|---|---|---|
| 4447 | 10/1926 | Australia | 220/351 |
| 0392899 | 10/1990 | European Pat. Off. | 70/63 |
| WO92/07494 | 5/1992 | PCT Int'l Appl. | 312/330.1 |
| 1085624 | 10/1967 | United Kingdom | 312/330.1 |

*Primary Examiner*—Lloyd A. Gall
*Attorney, Agent, or Firm*—Wood, Herron & Evans

[57] ABSTRACT

A vertically adjustable extension rail system for a drawer used in a housing having opposed vertical walls with a plurality of horizontally-extending, vertically-spaced guide ribs leaving alternating guide grooves. The extension rail system comprises two spaced apart extension rail assemblies with each extension rail assembly having a carrier rail and a slide rail which are slidably interconnected. A guide arm is mountable at a plurality of vertical levels along each of the slide rails. The guide arms are adapted for being lengthwise slidably received by opposing guide grooves on the vertical walls. A fixed or removable drawer receptacle can be mounted between the two extension rail assemblies.

13 Claims, 8 Drawing Sheets

VERTICALLY ADJUSTABLE EXTENSION DRAWERS

This application is a continuation of application Ser. No. 07/867,134, filed Apr. 10, 1992, now U.S. Pat. No. 5,211,461.

FIELD OF THE INVENTION

The present invention relates to drawers, and more particularly to drawers with vertically adjustable extension rail systems.

BACKGROUND OF THE INVENTION

Extension rail systems have been used to enable a drawer, and therefore its receptacle, to be fully extended out of a housing, such as a medication cart. Most extension rail systems are like those found in filing cabinets. These systems usually employ two extension rail assemblies, one assembly mounted on either side of the drawer receptacle. Each assembly usually comprises three interacting rails, with one of the rails being fixed to the receptacle, one of the rails being fixed to a vertical wall in the housing and a third or intermediate rail being located between the other two rails in each assembly. Typically, these rails are made of thin gage steel or other similar metal and many employ roller or ball bearing type assemblies which enable the three rails of each assembly to slidably interact along their length.

While this type of extension rail system is often associated with filing cabinets, they have also been employed for the drawers used in carts for storing and dispensing medication. Such medication carts often employ locking mechanisms for preventing the drawers from inadvertently extending open. In addition, security systems are often used with these locking mechanisms to limit access to authorized personnel. Such extension rail systems often suffer from a number of drawbacks. For example, the rails are susceptible to being permanently bent when the drawer is fully extended, and the roller or bearing assemblies are susceptible to being damaged. Once the rails are bent or the roller or bearing assemblies damaged, the rails are likely to bind or jam, making it difficult or even impossible to fully open or close the drawer (i.e. fully extend or retract the rails). If the rails become bent and jam to the point of preventing the drawer from being fully opened, access to medication located in the drawer may be blocked. If the drawer is prevented from being fully closed, then the locking mechanism and the security system may be inoperative. Such damage to the rail system would necessitate repairs which typically requires a maintenance mechanic and prevents at least the subject drawer from being used while repairs are conducted. Putting the entire cart or even just one drawer out of commission while repairs are conducted often wrecks routines and disrupts the dispensing of patient medication.

To perform properly, these metal extension rail systems require lubrication. When the drawers are fully extended, portions of the metal rails are exposed. Thus, medication dispensing personnel are susceptible to having their clothing or their person soiled by the lubrication. While most of the personnel who dispense medication from such carts are not required to be sterile, they are typically required to maintain a degree of cleanliness, such as clean hands and clean clothing. Therefore, an extension rail system which did not need lubrication would be desirable for use in such medication carts.

In the medication dispensing industry there is a need for various styles of medication storage and dispensing carts. These carts are used in a number of facilities such as hospitals, nursing homes and the like. Each such facility often has medication dispensing carts specially tailored to their individual requirements. For example, for a given cart design, one facility may require one combination of drawer sizes and another facility may require a different combination of drawer sizes. However, with existing extension rail systems, where the rails are fixed to the cart, adapting each cart to the needs of any given customer is typically labor intensive and expensive. Essentially, each cart has to be custom built. Manufacturing custom carts tailored to the needs of each facility could be economical if most of the components used to build the carts were standardized an easily interchangeable to adapt to each facilities requirements.

In some applications, the drawer receptacles are made removable. For example, sometimes the medication is held in re-usable containers which are stored in the drawer receptacle and the containers are cycle filled. In cycle filling, when the mediation is consumed, the drawer receptacle with all its empty containers is removed and taken to a pharmacy or other prescription filling facility where the containers are refilled with the appropriate medication. The drawer receptacle and the now filled containers are then returned to the medication dispensing facility. These removable drawer receptacles have typically been made of metal and shaped like a box. To accommodate the different size medication containers used by its customers, manufacturers of these medication carts have had to produce and inventory different size receptacles. One type drawer designed to accommodate such receptacles has a tray with an extension rail assembly fixed to each side and the removable receptacle sitting on the tray.

SUMMARY OF THE INVENTION

An object of the present invention is to make it easier and less expensive to custom build a drawer having an extension rail system.

Another object of the present invention is to provide a drawer having an extension rail system which is used in a housing having opposed vertical walls with a plurality of horizontally-extending, vertically-spaced guide ribs leaving alternating guide grooves, such that the drawer slidably mounts in opposing guide grooves.

An additional object of the present invention is to provide an extension rail system which is capable of locating a drawer at different vertical levels in such a housing, while the drawer remains mounted in the same guide grooves.

A further object of the present invention is to provide an extension rail system for a drawer which enables more combinations of different height drawers to fit within any given housing having opposed vertical walls with a plurality of horizontally-extending, vertically-spaced guide ribs leaving alternating guide grooves.

A still further object of the present invention is to provide an extension rail system for a drawer which is less likely to bind or jam.

Still another object of the present invention is to provide an extension rail system for a drawer which is more able to withstand being permanently bent.

Yet another object of the present invention is to provide an extension rail system for a drawer which is more easily adaptable for use with fixed and removable drawer receptacles It is an additional object of the present invention to provide an extension rail system for a drawer which does not need lubrication.

It is a further object of the present invention to provide an extension rail system for a drawer which requires less maintenance and repair over the life of the drawer.

It is another object of the present invention to provide a drawer having modular elements which, with slight modification, can be used to create a variety of drawer configurations.

The following is a list of some of the objects and advantages that drawers having the new extension rail system of the present invention attain:

1.) The raw material costs to produce each drawer are reduced.

2.) The labor costs associated with the assembly of each drawer are reduced and also such costs for the housings used with those drawers.

3.) Inventory costs are reduced by using interchangeable components.

4.) A design that can be shipped to another assembly point in knock-down version.

5.) Each drawer is more serviceable in the field.

A further object of the present invention is to provide a removable receptacle for a fully extendible drawer which is relatively inexpensive and easily adapted to fit in different height drawers.

These objects of the present invention are attained by providing a vertically adjustable extension rail system for a drawer used in a housing, such as a medication cart, having opposed vertical walls with a plurality of horizontally-extending, vertically-spaced guide ribs leaving alternating guide grooves. The extension rail system enables the drawer to slidably mount in opposing guide grooves. Such medication carts are disclosed in U.S. patent applications Ser. No. 07/662,750, filed Mar. 1, 1991, and Ser. No. 07/843,520, filed Feb. 28, 1992, both of which are incorporated by reference herein.

The extension rail system comprises two spaced apart extension rail assemblies with each extension rail assembly having a carrier rail and a slide rail which are slidably interconnected. A guide arm is mountable at a plurality of vertical levels along each of the slide rails. Each guide arm is adapted for being slidably received by the guide grooves on one of the vertical walls in the housing. The two extension rail assemblies are spaced apart so that a drawer receptacle can be mounted therebetween, thereby forming a drawer. The spaced apart relation of the two extension rail assemblies is maintained to ensure that the guide arms remain in slidable relation with the associated guide grooves while the drawer is in the housing. To prevent the drawers from being inadvertently pulled completely out of the housing, the guide arms for the drawer can be adapted to engage catch portions of the vertical walls at a point along the length of the associated grooves in the housing.

One feature of the present invention is the use of a metal box having two sides as the drawer receptacle, with each extension rail assembly being fixed to one side of the box.

Another feature of the present invention is the use of a plastic tub for the removable receptacle having vertical walls and a bottom. A plurality of horizontal, vertically-spaced upper ribs leaving alternating grooves are formed in an upper portion of the tub walls. Thus, a section of the upper portion of the walls can be cut off to form alternative height tubs, and if at least one upper rib remains, the walls of the tub will remain in relatively rigid. These horizontal upper ribs not only provide a structural stiffening effect to the tub walls, they also provide a surface for securing a lid over the upper opening of the tub.

An additional feature of the present invention is the use of resilient bumpers within each extension rail assembly to deaden any resulting noise when the assemblies are fully extended or fully retracted.

A further feature of the present invention is mounting a face plate to the drawer which can be easily adapted for alternative height drawers. The face plate has a top edge and a plurality of laterally-extending horizontal ridges which are vertically spaced at alternative drawer heights. The height of the face plate can be adapted by cutting or otherwise removing an upper portion of the face plate located directly above one of these horizontal ridges, with the now exposed ridge becoming the top edge.

Yet another feature of the present invention is the use of a security sleeve having four walls and a lockable openable top which ca be mounted within the walls of a box-shaped drawer receptacle such that a bottom portion of the box functions as a bottom for the security sleeve.

The above and other objects, features and advantages of the present invention will become apparent upon consideration of the detailed description and appended drawings.

DETAILED DESCRIPTION OF THE INVENTION

Figure 1:
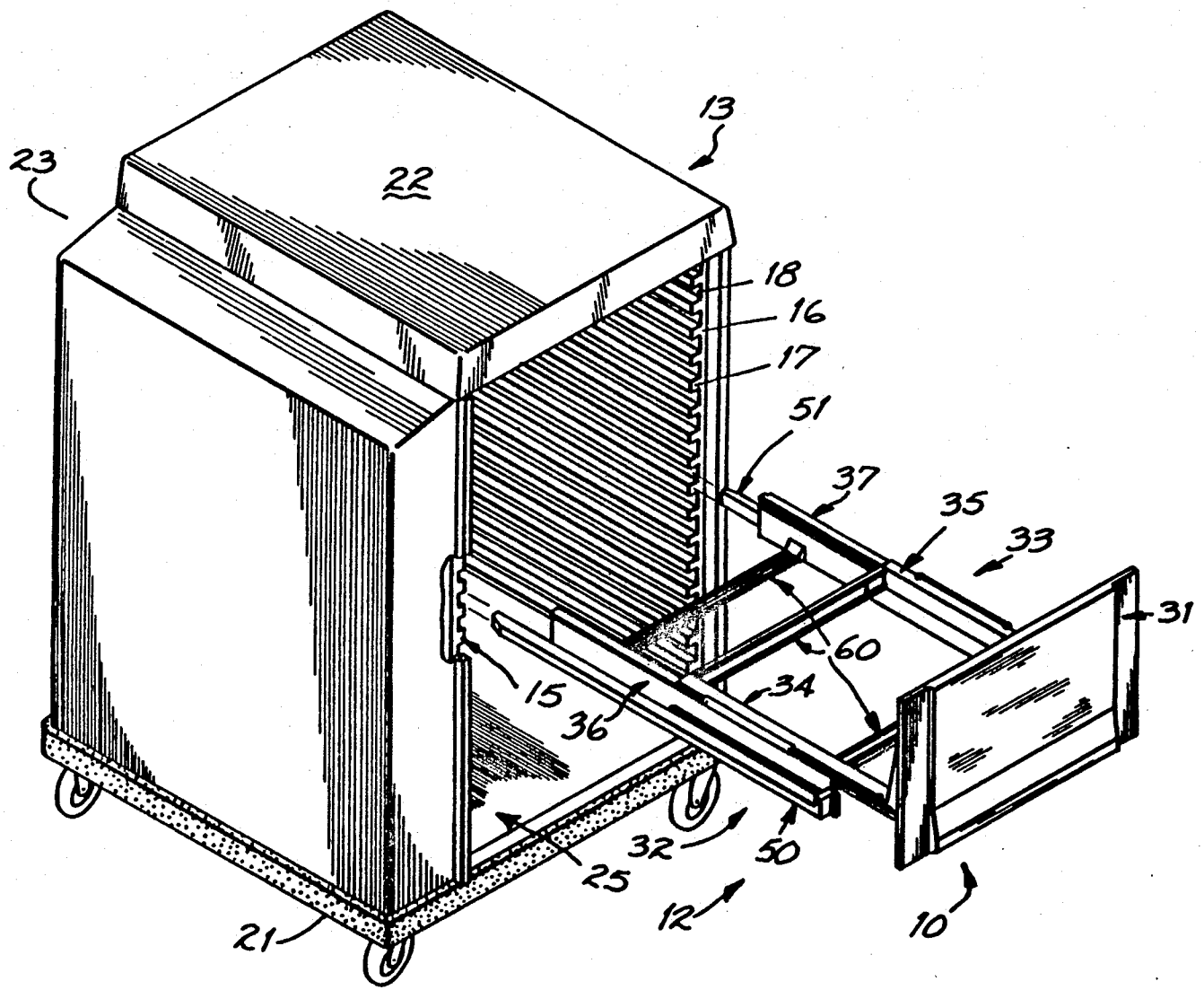
FIG. 1 is a perspective view of a partial drawer according to the present invention about to be inserted into a medication cart.

Referring to FIG. 1, drawers 10 having an extension rail system 12 according to the present invention are intended for use in a housing 13 having a first vertical wall 15 opposing a second vertical wall 16 with a plurality of horizontally-extending, vertically-spaced guide ribs 17 leaving alternating guide grooves 18 on each of the vertical walls 15 and 16 For the purposes of this detailed description, the housing 13 referred to will be a medication dispensing cart 13 having a wheeled platform 21 on which the vertical walls 15 and 16 are mounted, a top panel 22 mounted above the vertical walls 15 and 16 and a back panel 23. A drawer receiving cavity 25 is defined by the wheeled platform 21, the two vertical walls 15 and 16 and the top panel 22. A front end 26 of the cavity 25 is open and dimensioned to receive a plurality of drawers 10. A back end 27 of the cavity 26 is closed by the back panel 23. The extension rail system 12 enables a drawer receptacle 30 (See FIGS. 8 and 9) to be slidably mounted in at least one guide groove 18 on either vertical wall 15 and 16. In addition, the extension rail system 12 is capable of locating the drawer 10 at different vertical levels while the drawer 10 remains mounted in the same guide grooves 18.

Figure 2:
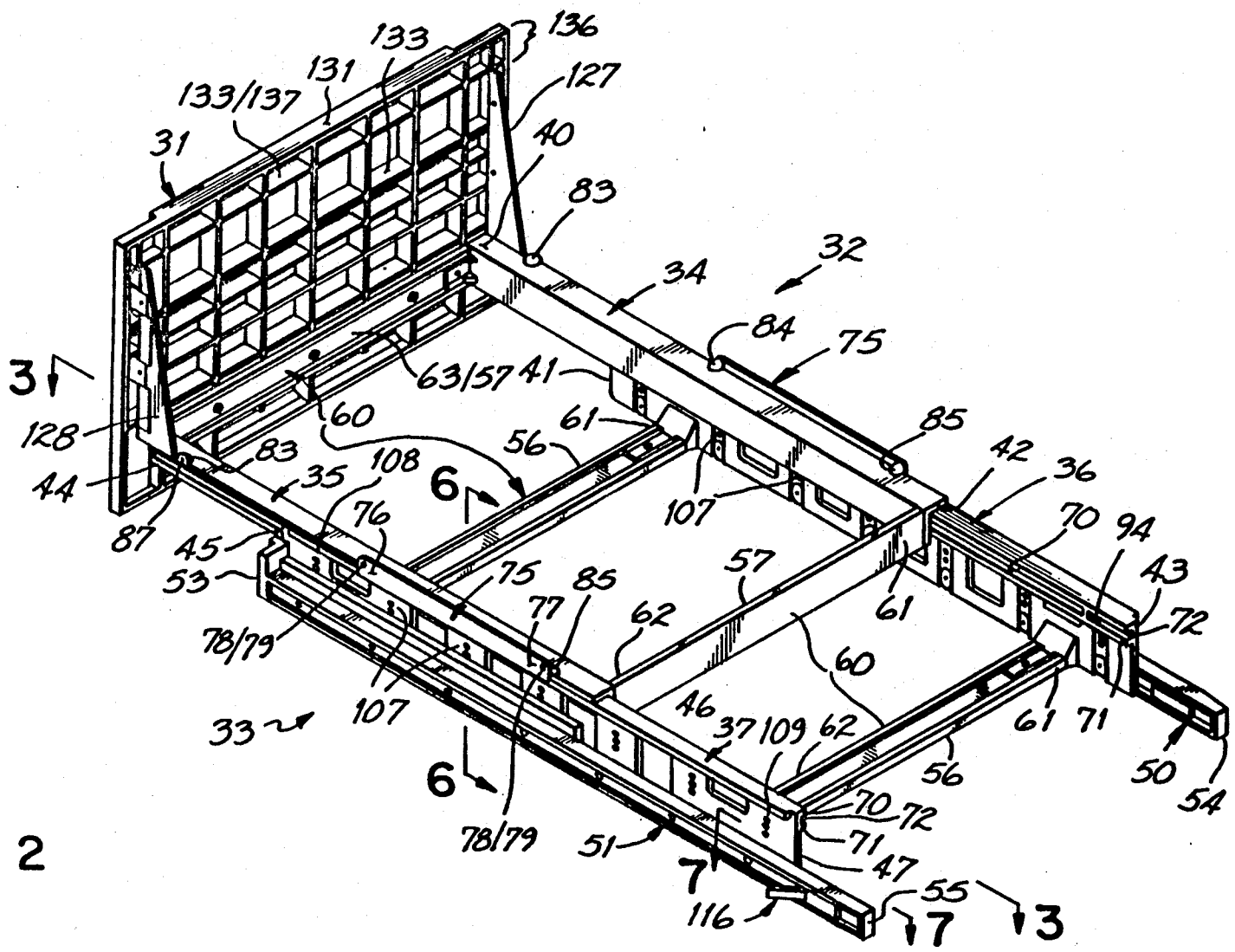
FIG. 2 is a perspective view of the partial drawer of FIG. 1.

Referring to FIG. 2, one possible extension rail system 12 used to form a drawer 10 according to the present invention is shown with a face plate 31 mounted thereto. This particular extension rail system 12 comprises a first extension rail assembly 32 and a second extension rail assembly 33. Each of the extension rail assemblies 32 and 33 has a carrier rail 34 and 35 and a slide rail 36 and 37, respectively. Each of the rails 34–37 is made of injection molded plastic, preferably a general purpose ABS. The carrier rail 34 and slide rail 36 of the first set 32 each have a leading end 40 and 41 and a trailing end 42 and 43, respectively. In addition, the carrier rail 35 and slide rail 37 of the second set 33 each have a leading end 44 and 45 and a trailing end 46 and 47, respectively. Each of the carrier rails 34 and 35 is slidably interconnected to its respective slide rail 36 and 37. A first guide arm 50 and a second guide arm 51 are each mountable at a plurality of vertical levels along the lateral side of the slide rails 36 and 37, respectively. Each of the guide arms 50 and 51 has a leading end 52 and 53 and a trailing end 54 and 55, respectively. Preferably, the guide arms 50 and 51 are longer than the slide rails 36 and 37 and are mounted such that the trailing end 54 and 55 of each of the guide arms 50 and 51 extends beyond the trailing end 43 and 47 of the slide rails 36 and 37. Each guide arm 50 and 51 is made of injection molded plastic, preferably a general purpose ABS. An aluminum reinforcing bar 49, preferably a 6063-T6 alloy, is insert molded along a length of each guide arm 50 and 51. A first pair 56 and a second pair 57 of longitudinally spaced and laterally oriented channeled braces 60 keep the two extension rail assemblies 32 and 33 in a spaced apart relation. Each brace 60 is made of aluminum, preferably 6063-T6. Each of the braces 60 of the first pair 56 have one end 61 mounted to the first slide rail 36 and the other end 62 mounted to the second slide rail 37. Each of the braces 60 of the second par 57 have one end 61 mounted to the first carrier rail 34 and the other end mounted to the second carrier rail 35. A leading brace 63 of the second pair 57 mounts, and thereby provides, the main support for the faceplate 31. To optimize interchangeability, each channeled brace 60 can be cut from the same aluminum extrusion. Thus, only the length of each channeled brace 60 would vary, depending upon the width drawer 10 desired. In addition, being made almost entirely of molded plastic and aluminum, the extension rail system 12 is relatively lightweight yet strong.

Figure 6:
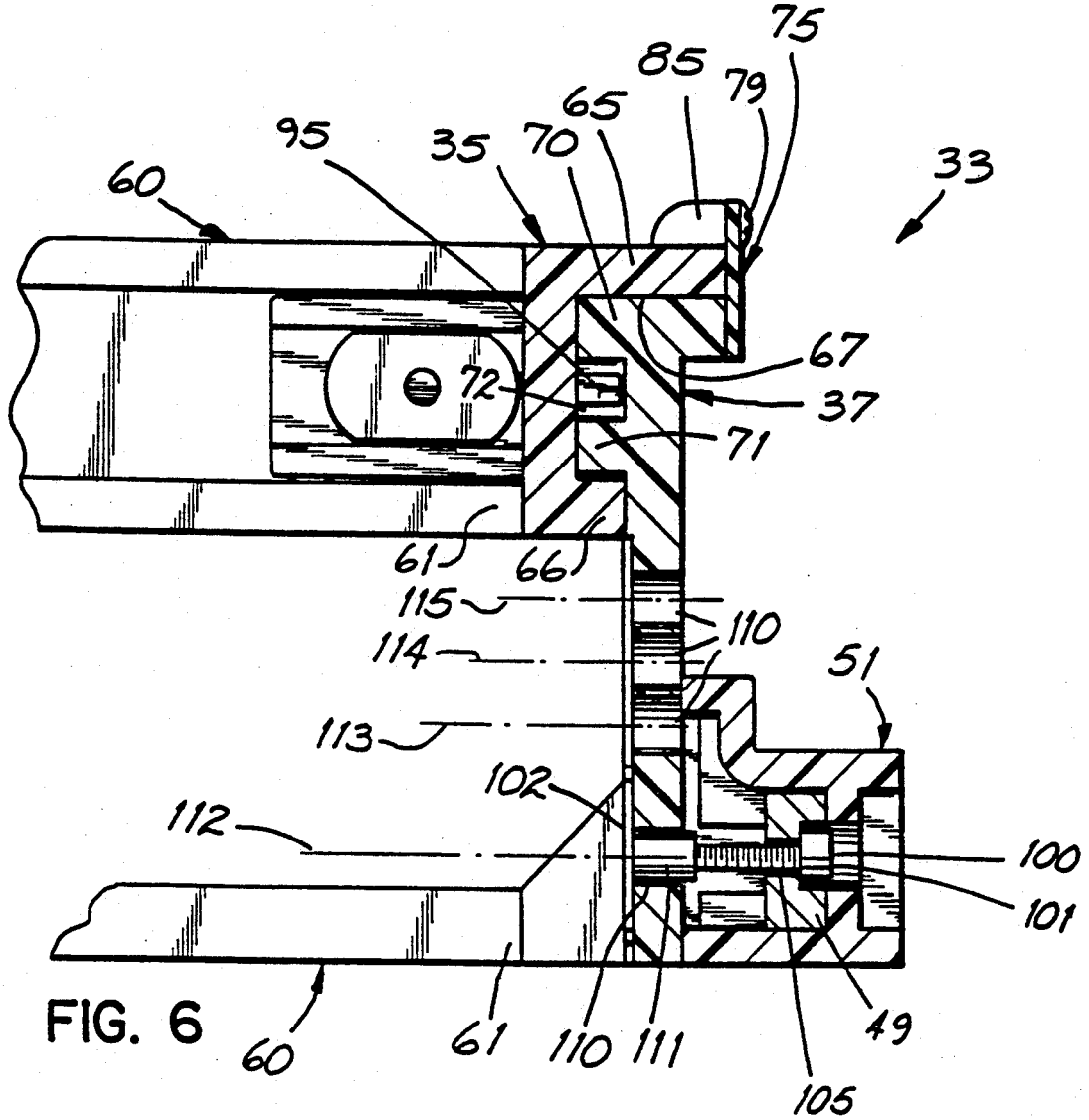
FIG. 6 is an enlarged sectional view taken along lines 6—6 of FIG. 2.

Referring to FIGS. 2 and 6, a spaced apart upper first ridge 65 and lower first ridge 66, run lengthwise along each of the carrier rails 34 and 35 forming a first channel 67. A spaced apart upper second ridge 70 and lower second ridge 71 run lengthwise along each of the slide rails 36 and 37 forming a second channel 72. When the carrier rails 34 and 35 are slidably interconnected with their respective slide rails 36 and 37, the second ridges 70 and 71 of each of the slide rails 36 and 37 lie between the first ridges 65 and 66 and within the first channel 67 of the respective carrier rails 34 and 35. Each upper first ridge 65 is wider than its lower first ridge 66. This permits a flat metal retaining strip 75 having opposite ends 76 and 77 to be fastened to the upper first ridge 65 of each carrier rail 34 and 35 in order to help retain each slide rail 36 and 37 in slidable relation with its respective carrier rail 34 and 35. Preferably, each end 76 and 77 of each retaining strip 75 has a hole 78 formed therein to receive the shank of a self tapping screw 79. A leading boss 83, a middle boss 84 and a trailing boss 85, are molded on the upper first ridge 65 of each carrier rail 34 and 35. Each of the bosses 83, 84 and 85 have a hole 87 dimensioned to receive one screw 79. The three bosses 83, 84 and 85 on each of the carrier rails 34 and 35 are spaced apart a distance equal to the length between end holes 78 on each retaining strip 75. Preferably, one retaining strip 75 is fastened, with one screw 79 for each end hole 78, to the middle boss 84 and trailing boss 85 of each carrier rail 34 and 35. Each retaining strip 75 is dimensioned to laterally overlap its respective slide rail 36 and 37. Thus, lateral movement of the second ridges 70 and 71 of each slide rail 36 and 37 out of the first channel 67 of its respective carrier rail 34 and 35 is blocked. Each carrier rail 34 and 35 has three bosses as opposed to two, to permit interchangeability between carrier rails. Thus, the middle boss 84 and one of the other bosses 83 or 85 can be used to mount the retaining strip 75.

Figure 3:
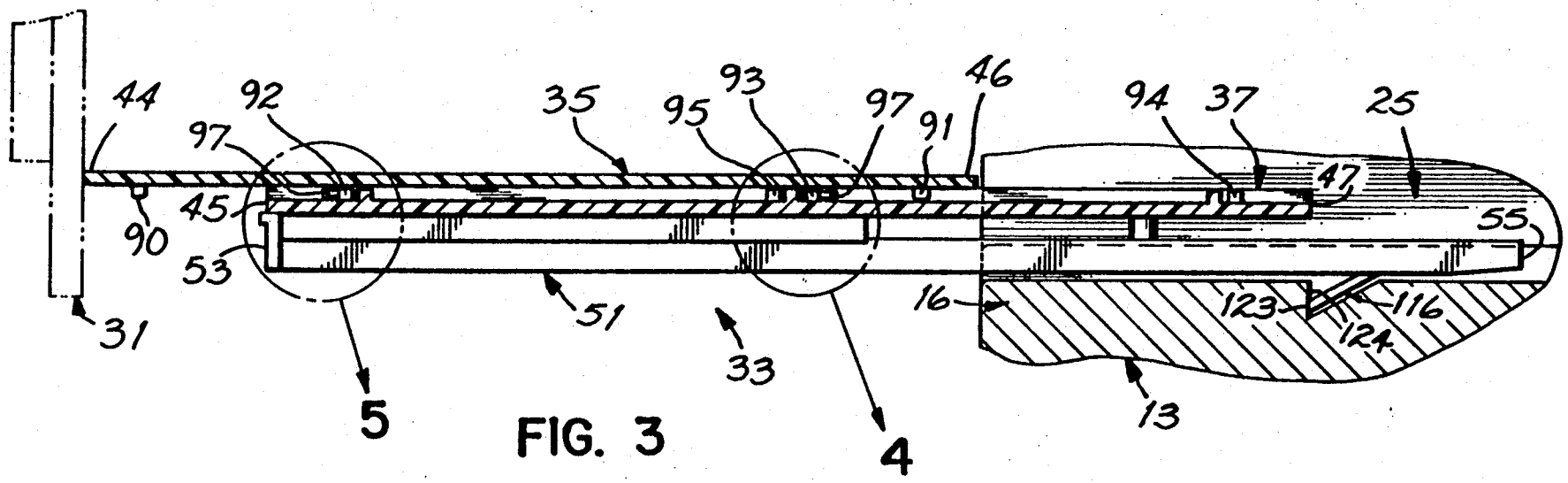
FIG. 3 is a sectional view taken along lines 3—3 of one extension rail assembly in the partial drawer of FIG. 2.
Figure 4:
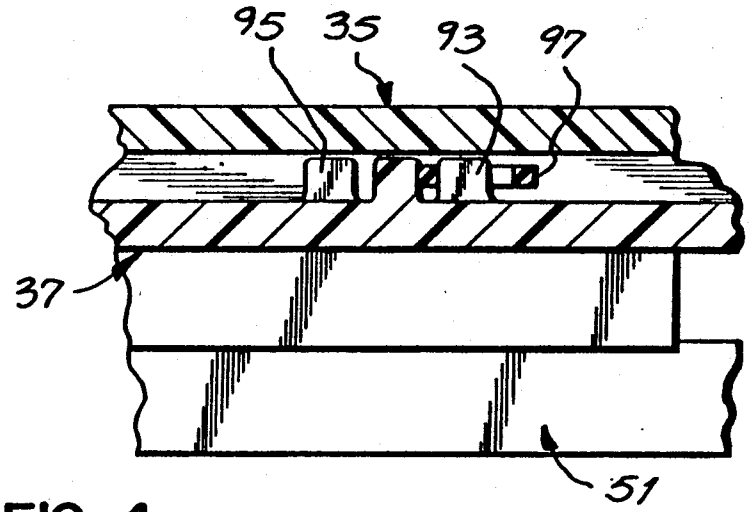
FIG. 4 is an enlarged view of the encircled area 4 of FIG. 3.
Figure 5:
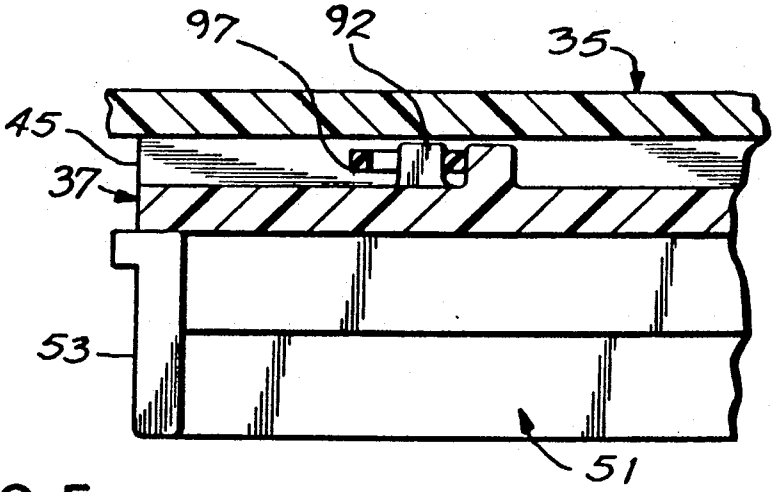
FIG. 5 is an enlarged view of the encircled area 5 of FIG. 3.

Referring to FIGS. 3–5, the carrier rail 34 and 35 and slide rail 36 and 37 of each extension rail assembly 32 and 33 is prevented from inadvertently sliding lengthwise completely apart. Lengthwise sliding between the rails of each assembly 32 and 33 is limited by forming a leading first stop stud 90 and a trailing first stop stud 91 in the first channel 67 of each of the carrier rails 34 and 35. In addition, the second channel 72 of each of the slide rails 36 and 37 has formed therein a primary leading second stop stud 92, a primary trailing second stop stud 93, an alternate leading second stop stud 94 and an alternate trailing second stop stud 95. Preferably, the first stop studs 90 and 91 in each carrier rail 34 and 35 are positioned halfway between the spaced first ridges 65 and 66 and are shorter than either second ridge 70 and 71. In addition, the second stop studs 92–95 on each slide rail 36 and 37 are positioned halfway between and are shorter than the spaced second ridges 70 and 71. Preferably, the leading first stop stud 90 is located adjacent to the leading end 40 and 44 of each carrier rail 34 and 35, and the trailing first stop stud 91 is located adjacent to the trailing end 42 and 46 of the carrier rail 34 and 35, respectively. The primary leading second stop stud 92 is located adjacent to the leading end 41 and 45 of the slide rails 36 and 37, and the alternate leading second stop stud 94 is located adjacent to the trailing end 43 and 47 of the slide rails 36 and 37, respectively. The primary and alternate trailing second stop studs 93 and 95 are each located on either side of the halfway point along the length of each slide rail 36 and 37, with each trailing second stop studs 93 and 95 being on opposite halves from their respective leading second stop studs 92 and 94. Only the primary second stop studs 92 and 93 are used at a time. By spacing the second stop studs 92–95 the same on each slide rail 36 and 37, the slide rails become interchangeable, with the alternate second stop studs 94 and 95 becoming the primary second stop studs 92 and 93 for one of the slide rails.

Lengthwise extension sliding between the carrier rail 34 and 35 and slide rail 36 and 37 of each extension rail assembly 32 and 33 is limited by the trailing first stop stud 91 of each carrier rail 34 and 35 making contact with the primary trailing second stop stud 93 of its respective slide rail 36 and 37. Likewise, lengthwise retraction sliding is limited by the leading first stop stud 90 of each of the carrier rails 34 and 35 making contact with the primary leading second stop stud 92 of its respective slide rail 36 and 37. Thus, the throw length for extension and retraction of each extension rail assembly 32 and 33 is dependent upon the stop stud spacing. A resilient bumper 97, such as a rubber ring, can be used to deaden any resulting noise when the stop studs contact each other. Preferably, one such bumper 97 is attached to each of the primary second stop studs 92 and 93 on each of the slide rails 36 and 37.

Figure 9:
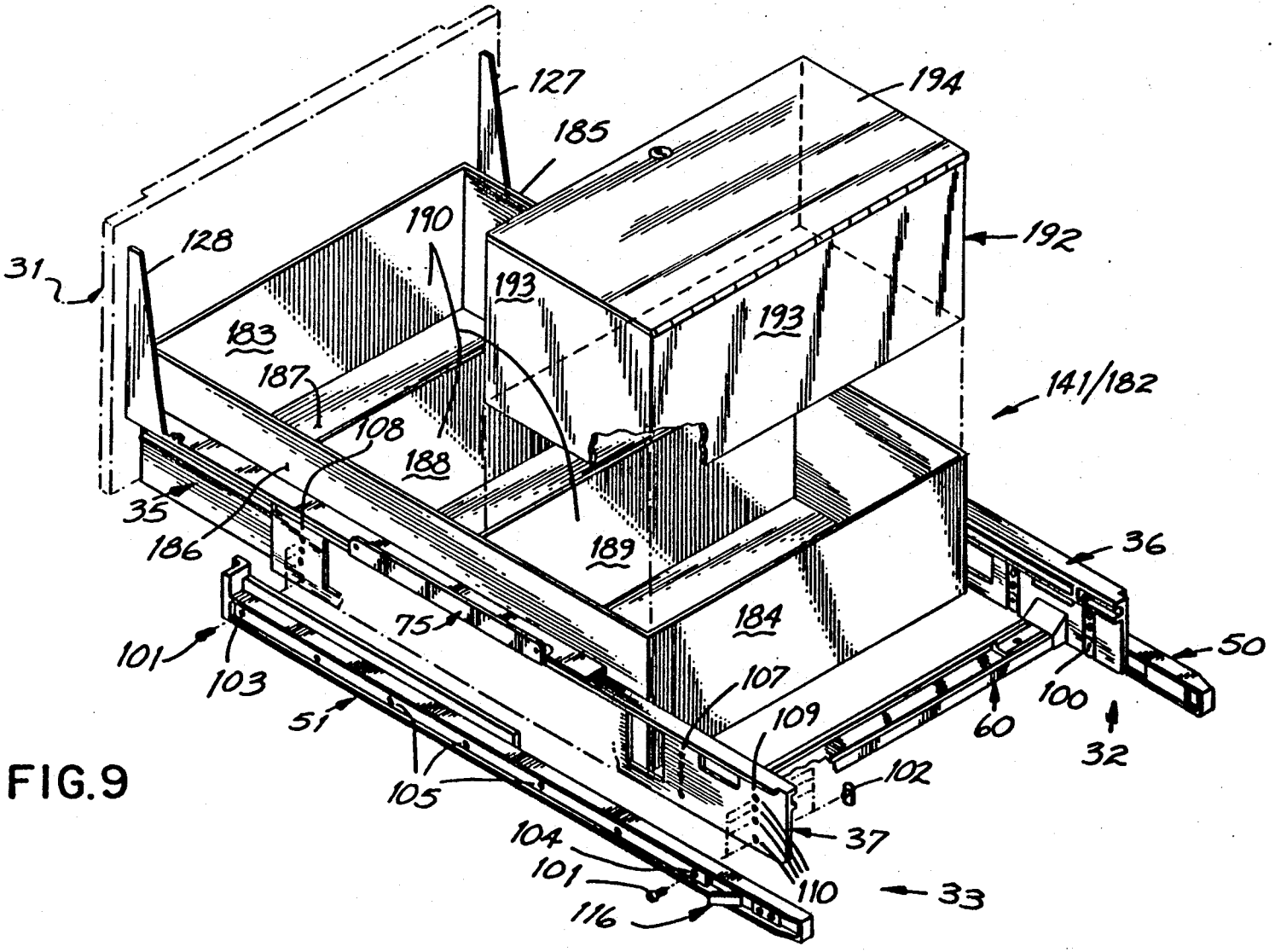
FIG. 9 is a perspective view of an alternative embodiment of the present drawer with a fixed drawer receptacle.
Figure 11:
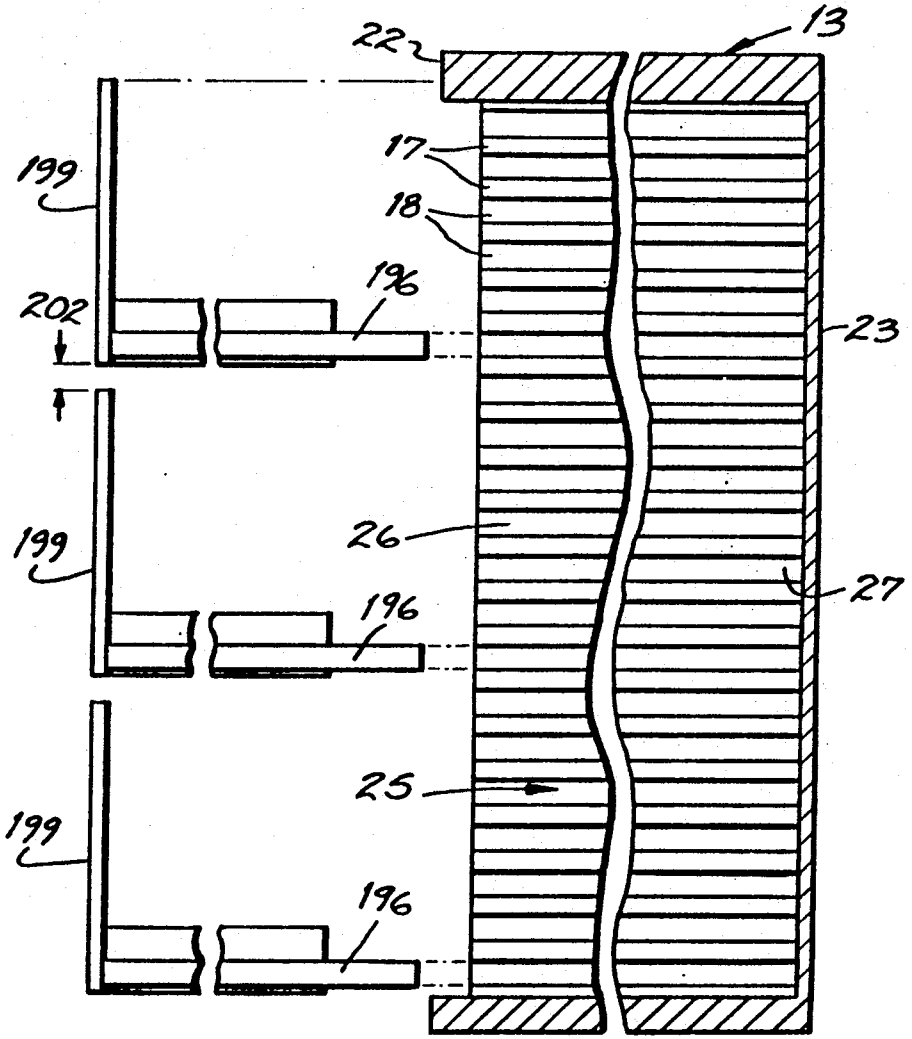
FIG. 11 is a sectional side view of a housing and drawers having guide arms at fixed vertical positions.

Referring to FIGS. 2, 6 and 9, the first and second guide arms 50 and 51 are each mounted to the first and second slide rails 36 and 37, respectively, with at least two fasteners 100. Depending upon the strength desired, more fasteners 100 can be used. Preferably, each fastener 100 comprises a bolt 101 and a slab base nut 102. Each of the guide arms 50 and 51 has at least a leading hole 103 and a trailing hole 104 formed therethrough, with additional holes 105 spaced between holes 103 and 104. Each of the holes 103, 104 and 105 is dimensioned to receive the threaded shank of one of the bolts 101. At least a leading row 108 and a trailing row 109 of a plurality of vertically spaced and aligned adjustment holes 110 are formed through each of the slide rails 36 and 37. Additional rows 107 of holes 110 are also spaced between rows 108 and 109. Each adjustment hole 110 is dimensioned to receive a threaded portion 111 of one of the slab base nuts 102. In this example, each row has four adjustment holes 110 corresponding to a first vertical level 112, a second vertical level 113, a third vertical level 114, and a fourth vertical level 115 for mounting each of the guide arms 50 and 51 (see also FIGS. 12*a–d*). The two vertical rows 108 and 109 of adjustment holes 110 on each of the slide rails 36 and 37 are longitudinally spaced to match the distance between the leading hole 103 and trailing hole 104 on its respective guide arm 50 and 51. The other rows 107 of holes 110 on each slide rail 36 and 37 are likewise spaced to match the holes 105 on the respective guide arms 50 and 51.

Thus, each of the guide arms 50 and 51 can be mounted to its respective slide rail 36 and 37 at a particular vertical level by inserting the shank of one bolt 101 through each of the guide arm holes 103 and 104, choosing the same vertical level for the vertical rows 108 and 109, inserting the threaded portion 111 of one slab base nut 102 medially into the chosen adjustment holes 110 and torquing each bolt 101 into its respective base nut 102. Each of the guide arms 50 and 51 can be unfastened from its respective slide rail 36 and 37 and remounted at a different vertical level by simply reversing and then repeating this procedure for whatever level desired (see FIG. 9). This procedure can be repeated for the additional guide arm holes 105 and matching rows 107 of slide rail adjustment holes 110, when greater strength is desired.

Figure 7:
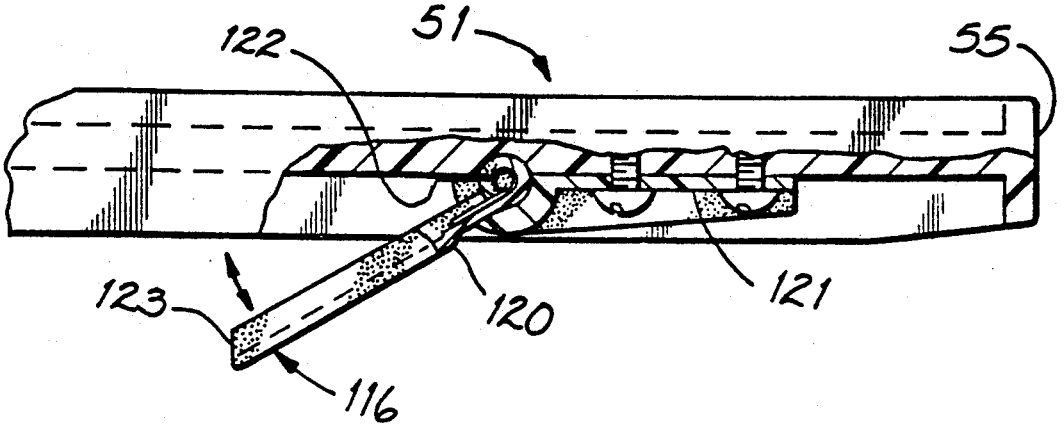
FIG. 7 is an enlarged partially broken away view taken along lines 7—7 of FIG. 2.

Referring to FIGS. 3 and 7, the two extension rail assemblies 32 and 33 can be prevented from sliding completely out of the medication cart 13, once installed in the cavity 25, by mounting a spring biased stop pin 116 to each of the guide arms 50 and 51. Mold used to form the carrier rails has removable inserts to form the wing brackets to some mold can form 1st, 2nd, or one without brackets. Each stop pin 116 has a trailing end 120 hinged or otherwise pivotally connected to a bracket 121 mounted preferably near the trailing end 54 and 55 of each of the guide arms 50 and 51. The stop pin 116 is biased laterally by a spring 122 to an acute angle from the guide arm 50 and 51. Thus, a leading end 123 of each stop pin 116 is in position to contact a catch portion 124 of each vertical wall 15 and 16 in order to prevent the two extension rail assemblies 32 and 33 from being pulled completely out of the medication cart 13.

A first wing bracket 127 and a second wing bracket 128 are formed on the leading end 40 and 44 of the first and second carrier rails 34 and 35, respectively, and used to partially mount the face plate 31 (see FIGS. 2 and 9). Preferably, one of the second pair 57 of channel braces 60 is mounted to the leading end 40 and 44 of the first and second carrier rails 34 and 35 and also fastened to the face plate 31 in order to better secure the face plate 31 to the extension rail system 12. The carrier rails 34 and 35 are preferably formed from one mold (not shown) having removable inserts (not shown) for forming one wing bracket at either end of the carrier rail. Thus, the carrier rails 34 and 35 can be molded without any wing brackets 127 and 128, when the drawer 10 is shallow enough that the face plate 31 does not need the additional support. The face plate 31 has a top edge 131, a bottom edge 132 and a plurality of laterally-extending, vertically-spaced horizontal ridges 133 integrally formed thereof. A number of these ridges 133 are vertically spaced from the bottom edge 132 of the face plate 31 at distances equal to alternative heights for the face plate 31. After choosing an alternative height for the face plate 31, an upper portion 136 of the face plate 31 directly above the ridge 133 corresponding to the chosen height can be cut off or otherwise removed, and this ridge 133 becomes a new top edge 137 of the face plate 31.

As previously discussed, a number of the components used to build the extension rail system 12 have been designed to optimize interchangeability. These components include the carrier rails 34 and 35, the slide rails 36 and 37, and the channeled braces 60. The guide arms 50 and 51 can also be made interchangeable.

Figure 8:
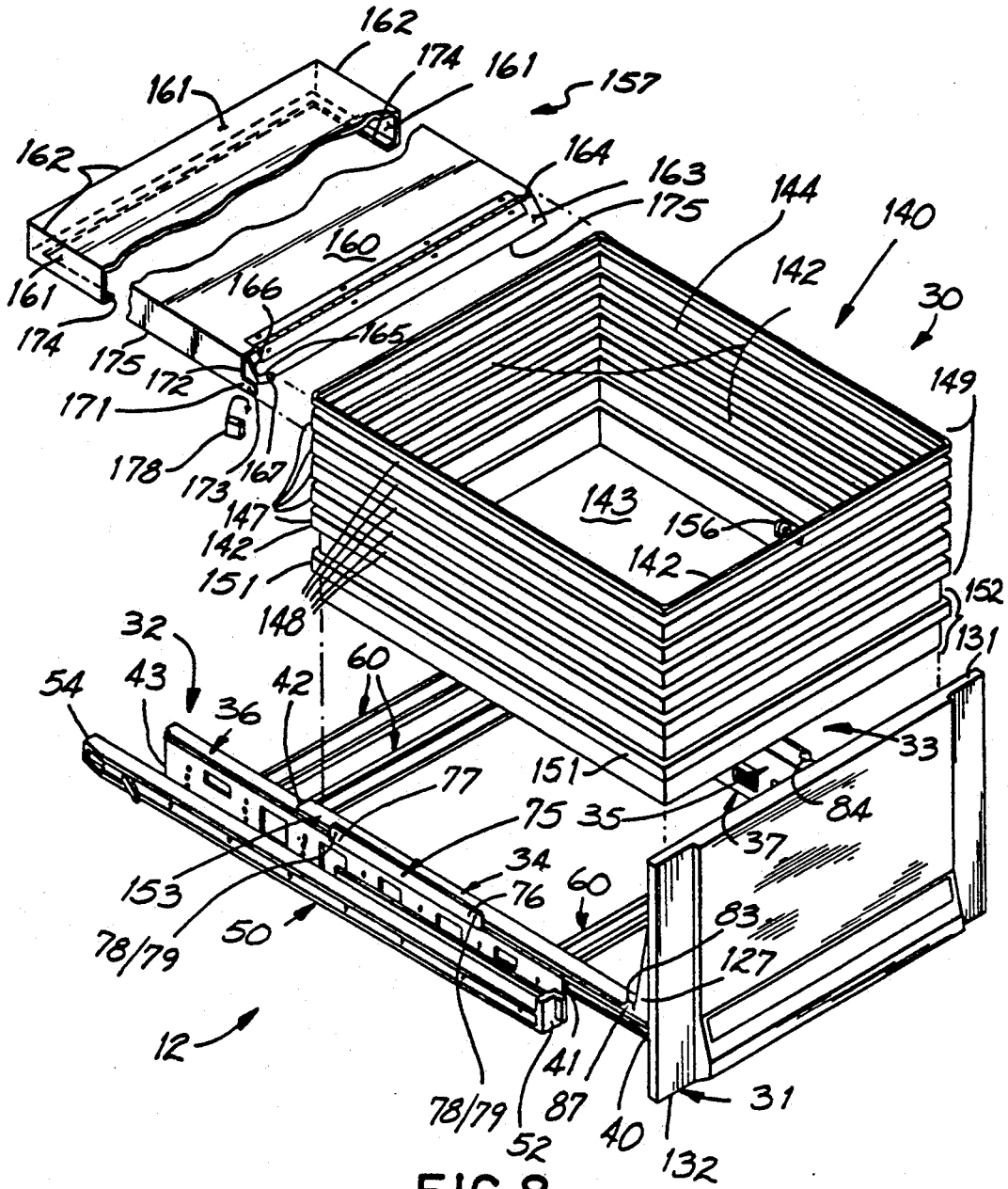
FIG. 8 is a perspective view of one embodiment of the present drawer with a removable drawer receptacle.

Referring to FIG. 8, the extension rail system 12 described above is suited for use with a removable drawer receptacle 140 as well as a fixed drawer receptacle 141 (See FIG. 9), with only minor if any modifications. When a removable drawer receptacle 140 is used, the one preferred is a plastic tub formed by rotational molding and made of polyethylene. The plastic tub 140 has four side walls 142, a bottom 143 and an upper opening 144. A plurality of horizontal, vertically-spaced upper ribs 147 leaving alternating grooves 148 are formed in an upper portion 149 of all four walls 142. A horizontal lower rib 151 is formed in a lower portion 152 of the four walls 142 between the upper ribs 147 and the tub bottom 143. The lower portion 152 of the tub 140 below the lower rib 151 is dimensioned to nest within a receiving frame 153 formed by the carrier rails 34 and 35 and the second pair 57 of channeled braces 60 mounted therebetween. The lower rib 151 rests on top of the receiving frame 153 such that the tub bottom 143 is suspended above the first pair 56 of braces 60 mounted between the slide rails 36 and 37. Preferably, a retaining bolt 156 is used to secure the tub 140 and the face plate 31 together for additional support. When the tub 140 has been removed from the receiving frame 153, it may be desirable to cover the tub opening 144 with a lid 157 in order to secure the contents of the tub 140. For example, such a lid 157 would be desirable if the tub 140 were used to store medication (not shown) held in reusable containers (not shown) which were cycle filled.

One possible lid 157 has a top 160, three fixed side walls 161 depending perpendicularly from the top 160 along an upper edge 162 of each of the fixed side walls 161, and one pivotable side wall 163 having an upper edge 164 hinged to the top 160. A first securing flange 165 is formed along a side edge 166 of the hinged side wall 163, with a hole 167 formed therethrough. A second securing flange 171 is formed along a side edge 172 on one of the walls 161 adjacent to the hinged side wall 163, also with a hole 173 formed therethrough. The two holes 167 and 173 are generally aligned and the two flanges 165 and 171 adjacent when the hinged side wall 163 hangs below the top 160 at a generally right angle. A lip 174 is formed on a lower edge 175 of at least two opposing side walls, and preferably on all four side walls 161 and 163. To secure the lid 157 over the tub opening 144, the hinged side wall 163 is rotated upward until it is at least coplanar with the lid top 160. The lid 157 is then slid over the tub opening 144 with each side wall 161 and 163 being dimensioned to allow the lips 174 to pass within an upper groove 148 on the tub 140. Each lip 174 is dimensioned to catch on the upper rib 147 directly above it, if an attempt were made to lift the lid 157 off of the tub 140. Once the lid 157 completely covers the tub opening 144, the hinged side wall 163 is lowered until the holes 167 and 173 in the two securing flanges 165 and 171 are aligned. At this point, a plastic seal tab 178 or a padlock (not shown) can be inserted through the two holes 167 and 173 to make the tub 140 tamper resistant.

Referring to FIG. 9, the extension rail system 12 previously described can be easily modified to accommodate a fixed drawer receptacle 182, such as a metal box for containing medication (not shown). In this example, the metal box 182 has a front wall 183, a back wall 184, a first side wall 185, a second side wall 186, a bottom 187, and two longitudinally spaced partition walls 188 and 189 extending from one side wall to the other, separating the box into three compartments 190. To accommodate this type drawer receptacle, the second pair 57 of channeled braces 60 mounted to the carrier rails 34 and 35 are removed, with the first side wall 185 and second side wall 186 each mounting the carrier rails 34 and 35 of the first and second extension rail assemblies 32 and 33, respectively. With the leading brace 63 now removed, the face plate 31 is mounted to the front wall 183. A security sleeve 192 having four walls 193 and a lockable openable lid 194 can be dimensioned to fit within one of the compartments 190 formed by the partition walls 188 and 189. The bottom 187 of the metal box 182 functions as a bottom for the security sleeve 192. The sleeve 192 can be fixed in place by riveting or otherwise fastening together walls of the sleeve 192 located adjacent to walls of the metal box 182.

In operation, the extension rail system 12, with or without a drawer receptacle 30, is inserted into the cart housing 13 by positioning both extension rail assemblies 32 and 33 between the two opposing vertical walls 15 and 16 of the medication cart 13, aligning the guide arms 50 and 51 with corresponding opposing guide grooves 18 and pushing the drawer 10 backward toward the back panel 23 until the drawer 10 is fully closed within the cart cavity 25. During insertion of the drawer 10, the stop pins 116 are forced against their respective guide arms 50 and 51 by the corresponding guide grooves 18, removing them as an obstruction. The drawer 10 can be fully extended by pulling the face plate 31 away from the back panel 23 and out of the cart cavity 25. Pulling outward in this manner causes each guide arm 50 and 51 to slide outwardly lengthwise along its respective guide groove 18 until the leading end 123 of the stop pins 116 contact the catch portion 124 of its respective vertical wall 15 and 16. The forward progress of the slide rails 36 and 37 is thus halted. Continuing to pull on the face plate 31 causes the carrier rails 34 and 35 to extend forward of the slide rails 36 and 37 until the trailing first stop stud 91 and the primary trailing second stop stud 93 of each extension rail assembly 32 and 33 make contact, as previously described. At this point the drawer 10 is fully extended, and the entire drawer receptacle 30 should be located outside the cart housing 13. The drawer 10 is closed by pushing the face plate 31 backward toward the back panel 23, causing each of the carrier rails 34 and 35 and slide rails 36 and 37 to slidably retract back together until the leading first stop stud 90 and the primary leading second stop stud 92 of each extension rail assembly 32 and 33 make contact, as previously described. Continuing to push on the face plate 31 causes the guide arms 50 and 51 to slide on their respective guide grooves 18 toward the back panel 23 of the cart 13 until the drawer 10 is fully closed within the cart cavity 25. When the guide arms 50 and 51 slide rearwardly, the stop pins 116 are forced against the guide arms 50 and 51, again removing them as an obstruction.

FIGS. 10–14 are herein used to demonstrate some of the advantages of the present invention. As discussed earlier, it is desirable to manufacture medication carts using standard vertical walls 15 and 16 having one guide rib 17 design or pattern. However, without the vertical adjustment feature of the present extension rail system 12, the variety of drawer 10 combinations (i.e. different height drawers) available for a given guide rib 17 pattern is significantly limited.

Figure 10:
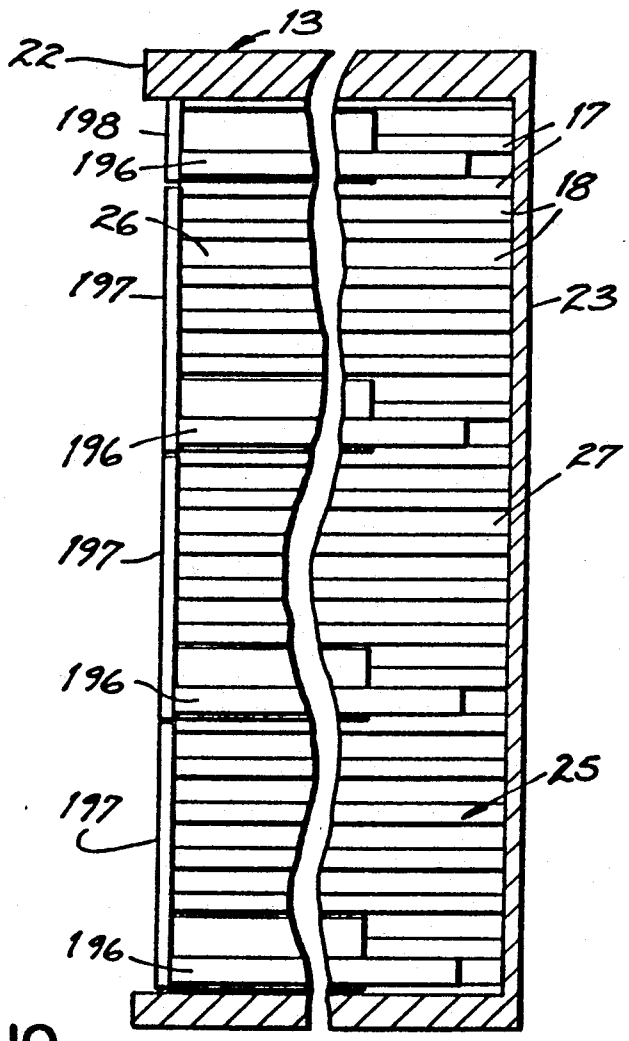
FIG. 10 is a sectional side view of a housing containing drawers with guide arms at a fixed vertical location.
Figure 12A:
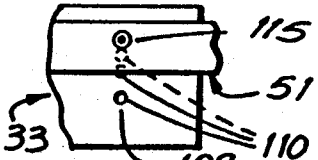
FIGS. 12*a*, 12*b*, 12*c* and 12*d* are side views of all the possible vertical locations of each guide arm in the embodiment of FIG. 1.
Figure 12B:
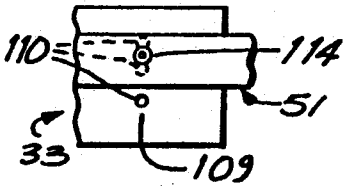
Figure 12C:
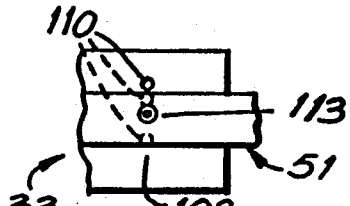
Figure 12D:
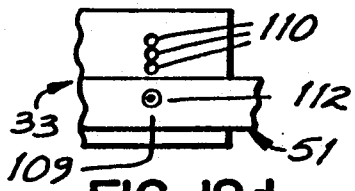

Referring to FIG. 10, a basic cart housing 13 is shown with, for example, guide ribs 17 which repeat every 1.5 inches on vertical walls 15 and 16 which are 30 inches high. With such a guide rib pattern, when the guide arms 196 for each drawer 10 are fixed (i.e. not vertically adjustable), the drawers 10 used to fill the cart cavity 25 must each have a height divisible by 1.5 inches. For example, three 9 inch drawers 197 and one 3 inch drawer 198, totaling 30 inches (as shown in FIG. 10). However, if three 10 inch drawers 199 with fixed guide arms 196 are used with the same cart 13 and guide rib pattern, a one half inch gap 202 will separate each 10 inch drawer 199 preventing one of the drawers from fitting properly in the cart 13 (see FIG. 11). By making the guide arms 50 and 51 vertically adjustable on each extension rail assembly 32 and 33, the vertical location of each of the 10 inch drawers 199 within the cart cavity 25 can be adjusted without moving the guide arms 50 and 51 to another guide groove 18 (i.e., vertical) location. Thus, as shown in FIG. 13, the vertical adjustability of the present extension rail system 12 enables the three 10 inch drawers 199, as well as other combinations of drawer heights, to fit within the 30 inch high cart cavity 25.

Figure 13:
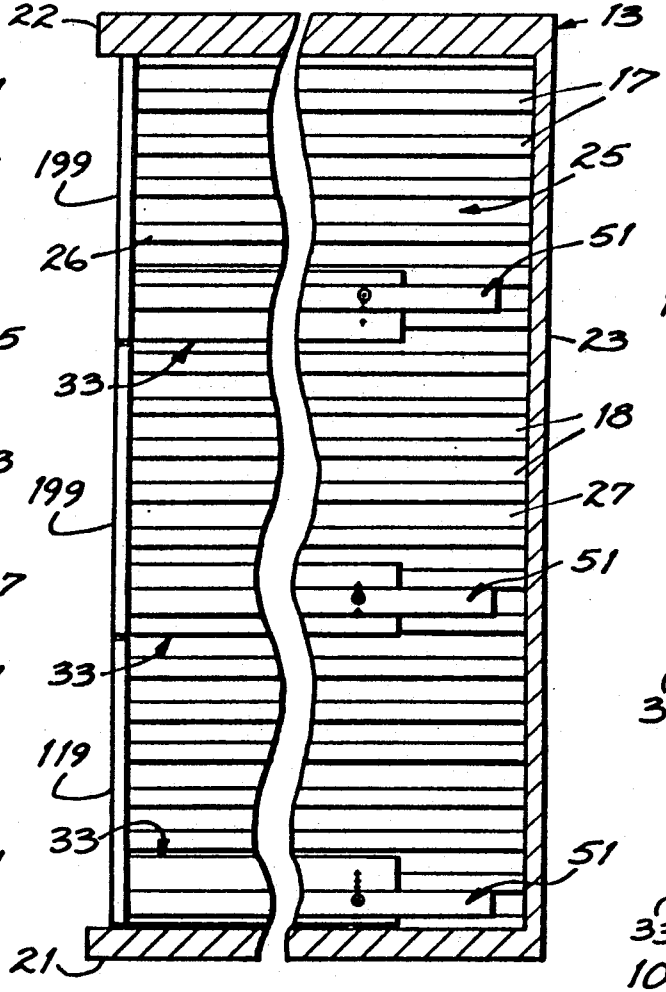
FIG. 13 is a partially sectioned side view of a housing containing one possible combination of demonstrative drawers according to the present invention.
Figure 14:
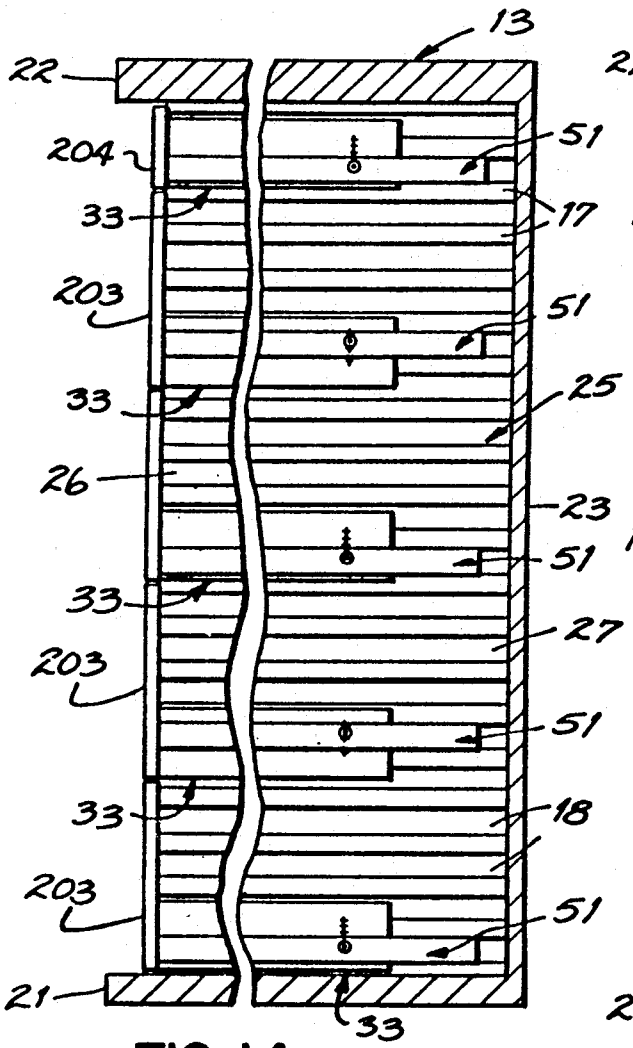
FIG. 14 is a sectional side view of a housing containing another possible combination of demonstrative drawers according to the present invention.

Referring to FIGS. 12–14, for the above described guide rib pattern, the one half inch gap 202 between the three 10 inch drawers 199 can be eliminated by fastening the guide arms 50 and 51 for the bottom 10 inch drawer 199 in the adjustment holes 110 at the first level 112, those for the middle 10 inch drawer 199 in the adjustment holes 110 at the second level 113 and those for the top 10 inch drawer 199 in the adjustment holes 110 at the fourth level 115. The distance between the first level 112 and second level 113 is half an inch and between the second level 113 and fourth level 115 is half an inch. Another drawer combination not possible with fixed guide arms 196 is illustrated in FIG. 14, namely, four 6.75 inch drawers 203 and one 3 inch drawer 204. With this combination, the guide arms 50 and 51 for the 6.75 inch drawers 203 alternate being mounted at the first level 112 and third levels 114, starting off with the bottom 6.75 inch drawer 203 being mounted at the first level 112. The 3 inch drawer 204 is the top drawer and its guide arms 50 and 51 are mounted at the first level 112. Clearly evidenced by these illustrations, the vertical adjustability of the present extension rail system 12 provides a versatility in possible drawer 10 combinations for such housings 13 that was heretofore unattainable.

From the above disclosure of the general principles of the present invention and the preceding detailed description, those skilled in the art will readily comprehend the various modifications to which the present invention is susceptible. Therefore, the scope of this invention should be limited only by the following claims and equivalents thereof.

What is claimed is:

1. A removable receptacle for use in a medication cart drawer having a receptacle receiving frame, said receptacle comprising:

a tub including four side walls and a bottom wall being connected to one another to define an upper opening and an interior receiving space, two opposed side walls having a plurality of vertically spaced horizontal ribs on an outer surface thereof, said ribs defining horizontal grooves therebetween and said side walls adapted to be cut to allow the receptacle to be shortened to a desired height; and, a removable lid including a top and two fixed side walls extending downwardly from said top, said two fixed side walls including inwardly extending lips each being dimensioned and located on said fixed side walls so as to be respectively receivable in a sliding manner in two predetermined horizontal grooves, each of said predetermined horizontal grooves located in a respective opposed side wall of said tub.

2. The receptacle of claim 1 wherein all four of said side walls of said tube include a plurality of vertically spaced horizontal ribs on an outer surface thereof.

3. The receptacle of claim 2 wherein all four of said side walls of said tub further include vertically spaced horizontal ribs on an inner surface thereof.

4. The receptacle of claim 2 wherein said lid further includes a third fixed side wall extending downwardly from said top.

5. The receptacle of claim 4 wherein said third fixed side wall further includes an inwardly extending lip dimensioned and located on said third fixed side wall so as to be receivable in a horizontal groove located in a third side wall of said tub which extends between said two opposed side walls of said tub.

6. The receptacle of claim 5 wherein said lid further includes a fourth, pivotable side wall hinged to said top, said fourth, pivotable side wall having an inwardly extending lip dimensioned and located so as to be receivable in a horizontal groove located in a fourth side wall of said tub extending between said two opposed side walls of said tub.

7. The receptacle of claim 6 further comprising means for securing said fourth, pivotable side wall in a lowered position with the lip of said fourth, pivotable side wall retained in said horizontal groove located in said fourth side wall of said tub.

8. The receptacle of claim 7 wherein said means for securing said fourth, pivotable side wall further comprises tamper resistant locking means for locking said fourth, pivotable side wall in said lowered position.

9. The receptacle of claim 1 wherein said lid further includes a third fixed side wall extending downwardly from said top.

10. The receptacle of claim 9 wherein said lid further includes a fourth, pivotable side wall hinged to said top.

11. The receptacle of claim 10 further comprising means for securing said fourth, pivotable side wall in a lowered position.

12. The receptacle of claim 11 wherein said means for securing said fourth, pivotable side wall further comprises tamper resistant locking means for locking said fourth, pivotable side wall in said lowered position.

13. A method of making a removable receptacle for use in a medication cart drawer having a receptacle receiving frame, the method comprising the steps of:

forming a plastic tub sized to nest in said receiving frame and including for side walls and a bottom wall being connected to one another to define an upper opening and an interior receiving space, two opposed side walls having a plurality of vertically spaced horizontal ribs on an outer surface thereof, said ribs defining horizontal grooves therebetween, cutting a section of an upper portion of said walls to form a tub having a predetermined shortened height but leaving at least one horizontal upper rib.

* * * * *